US008215082B2

(12) United States Patent
Stein

(10) Patent No.: US 8,215,082 B2
(45) Date of Patent: Jul. 10, 2012

(54) FLAT ROOF THAT SHEDS RAIN

(76) Inventor: Alejandro Stein, Crans-Pres-Celigny (CH)

( * ) Notice: Subject to any disclaimer, the term of this patent is extended or adjusted under 35 U.S.C. 154(b) by 0 days.

(21) Appl. No.: 12/806,530

(22) Filed: Aug. 13, 2010

(65) Prior Publication Data

US 2012/0036792 A1 Feb. 16, 2012

(51) Int. Cl.

| | |
|---|---|
| ***E04D 13/00*** | (2006.01) |
| ***E04B 1/10*** | (2006.01) |
| ***E04B 1/70*** | (2006.01) |
| ***E04B 1/00*** | (2006.01) |

(52) U.S. Cl. ..... 52/745.05; 52/11; 52/13; 52/301; 52/302.1; 52/233

(58) Field of Classification Search ..... 52/11, 13, 52/233, 301, 302.1

See application file for complete search history.

(56) References Cited

U.S. PATENT DOCUMENTS

| | | | | | |
|---|---|---|---|---|---|
| 1,943,033 | A * | 1/1934 | Midby | 52/233 |
| 3,892,097 | A * | 7/1975 | Bain | 52/233 |
| 4,012,876 | A * | 3/1977 | Grubbs | 52/233 |
| 4,219,977 | A * | 9/1980 | Bene et al. | 52/94 |
| 4,433,519 | A * | 2/1984 | Jenkins | 52/233 |
| 4,619,089 | A | 10/1986 | Stein | |
| 5,271,878 | A * | 12/1993 | Mizia et al. | 264/45.5 |
| 5,282,343 | A | 2/1994 | Stein | |
| 5,577,357 | A * | 11/1996 | Civelli | 52/233 |
| 5,601,849 | A * | 2/1997 | Dunstan et al. | 424/660 |
| 5,878,542 | A * | 3/1999 | Cornelius | 52/519 |
| 6,543,193 | B2 * | 4/2003 | Houseal | 52/233 |
| 6,729,084 | B2 * | 5/2004 | Neal | 52/233 |
| 6,786,015 | B2 * | 9/2004 | Wilt | 52/233 |
| 7,661,230 | B2 * | 2/2010 | Peaco | 52/233 |
| 2002/0046519 | A1 * | 4/2002 | Houseal | 52/233 |
| 2003/0068457 | A1 * | 4/2003 | McCain | 428/40.1 |
| 2004/0182023 | A1 * | 9/2004 | Chambers | 52/233 |
| 2004/0187411 | A1 * | 9/2004 | Clegg | 52/233 |
| 2005/0115177 | A1 * | 6/2005 | Morgenstern | 52/233 |
| 2005/0126084 | A1 * | 6/2005 | Woksa et al. | 52/79.1 |
| 2006/0168904 | A1 * | 8/2006 | Muszynski | 52/233 |
| 2006/0248825 | A1 * | 11/2006 | Garringer | 52/233 |
| 2007/0220820 | A1 * | 9/2007 | Chambers | 52/233 |
| 2008/0083177 | A1 * | 4/2008 | Tiberi et al. | 52/233 |
| 2008/0127583 | A1 * | 6/2008 | Wrightman et al. | 52/233 |
| 2008/0250743 | A1 * | 10/2008 | Exposito | 52/543 |
| 2008/0282629 | A1 * | 11/2008 | Cook et al. | 52/233 |
| 2009/0133345 | A1 * | 5/2009 | Wrightman | 52/233 |
| 2009/0151279 | A1 * | 6/2009 | Perron | 52/233 |
| 2009/0199497 | A1 * | 8/2009 | Wrightman | 52/233 |
| 2009/0293390 | A1 * | 12/2009 | Anderson | 52/233 |

(Continued)

*Primary Examiner* — Mark Wendell
(74) *Attorney, Agent, or Firm* — Donald S. Dowden

(57) ABSTRACT

A substantially flat roof has elongated log-shaped members arranged horizontally in adjacent, side-by-side relation. Each log-shaped member has a contoured upper surface, and the contoured upper surfaces of adjacent members define a space between them that tapers from a maximum width at the highest elevation of the contoured surfaces to a minimum width where the contoured surfaces of adjacent log-shaped members are closest together. Elongated inserts are arranged between the contoured upper surfaces. Each insert has a wide portion that abuts an adjacent pair of the contoured upper surfaces at a relatively high elevation, and tapers to a narrow portion that abuts the contoured surfaces at a relatively low elevation substantially at the ends of the adjacent pair of log-shaped members. Rain falling on the roof drains by gravity from the contoured upper surfaces to the inserts and along the inserts towards their narrow portions and falls from the roof.

8 Claims, 3 Drawing Sheets

U.S. PATENT DOCUMENTS

2010/0043323 A1* 2/2010 Wrightman ..... 52/233
2010/0088979 A1* 4/2010 Stein ..... 52/144
2010/0101169 A1* 4/2010 Logan et al. ..... 52/518
2010/0139080 A1* 6/2010 Baum, Jr. ..... 29/592
2011/0078966 A1* 4/2011 Herman ..... 52/233

* cited by examiner

FLAT ROOF THAT SHEDS RAIN

BACKGROUND OF THE INVENTION

1. Field of the Invention

This invention relates to roofs and, more particularly, to a novel and highly effective roof that combines important advantages of flat roofs and pitched roofs and has features that make it especially desirable in situations where construction costs must be kept to a minimum.

2. Description of the Prior Art

Roofs can be flat or pitched. Each type has advantages and disadvantages.

If other factors are equal, a flat roof is easier and less expensive to construct than a pitched roof. At the highest level of the supporting walls, a minimum of material and labor is required to construct a flat roof covering the space enclosed by the walls and protecting it against weather.

On the other hand, flat roofs do not shed rain very well. Rainwater accumulates in small pockets or indentations in a flat roof that are inevitable even in expensive structures and often quite noticeable in low-cost structures. Overlapping of tiles, shingles or rolls of roofing material in a flat roof provides inadequate protection against rain. This places a heavy burden on the waterproofing material employed.

A pitched roof sheds rain efficiently. Rainwater flows by gravity from a higher elevation, often but not necessarily near a midline of the roof, to a lower elevation at the roof's edge and falls from the roof's edge into a gutter or onto the ground.

On the other hand, a pitched roof requires for its support the construction atop the walls of one or more gables or similar structures, which are unnecessary in the case of a flat roof. Moreover, a pitched roof must have an area larger than the area of the space it covers; the steeper the pitch the greater the disparity between the roof area and the covered area. A pitched roof is also more dangerous to construct and repair than a flat roof because of the greater risk that a worker will slip and fall to the ground.

There is a need for a roof combining the advantages of flat and pitched roofs and avoiding their disadvantages, especially in situations where costs must be kept to a minimum.

OBJECTS AND SUMMARY OF THE INVENTION

An object of the invention is to provide a roof that remedies the deficiencies of the prior art noted above and in particular to provide a roof that has important advantages of both flat and pitched roofs while avoiding their major disadvantages.

In more detail, objects of the invention include providing a roof that:

- can be installed at low cost, with a minimum of material and labor;
- sheds rain efficiently;
- does not require the erection atop the supporting walls of gables or similar structures;
- has an area not substantially larger than the area of the space it covers; and
- is relatively safe for workers to install and repair.

BRIEF DESCRIPTION OF THE DRAWINGS

A better understanding of the objects, features and advantages of the invention can be gained from a consideration of the following detailed description of its preferred embodiments, together with the appended drawings, wherein.

DETAILED DESCRIPTION OF THE INVENTION

Figure 1:
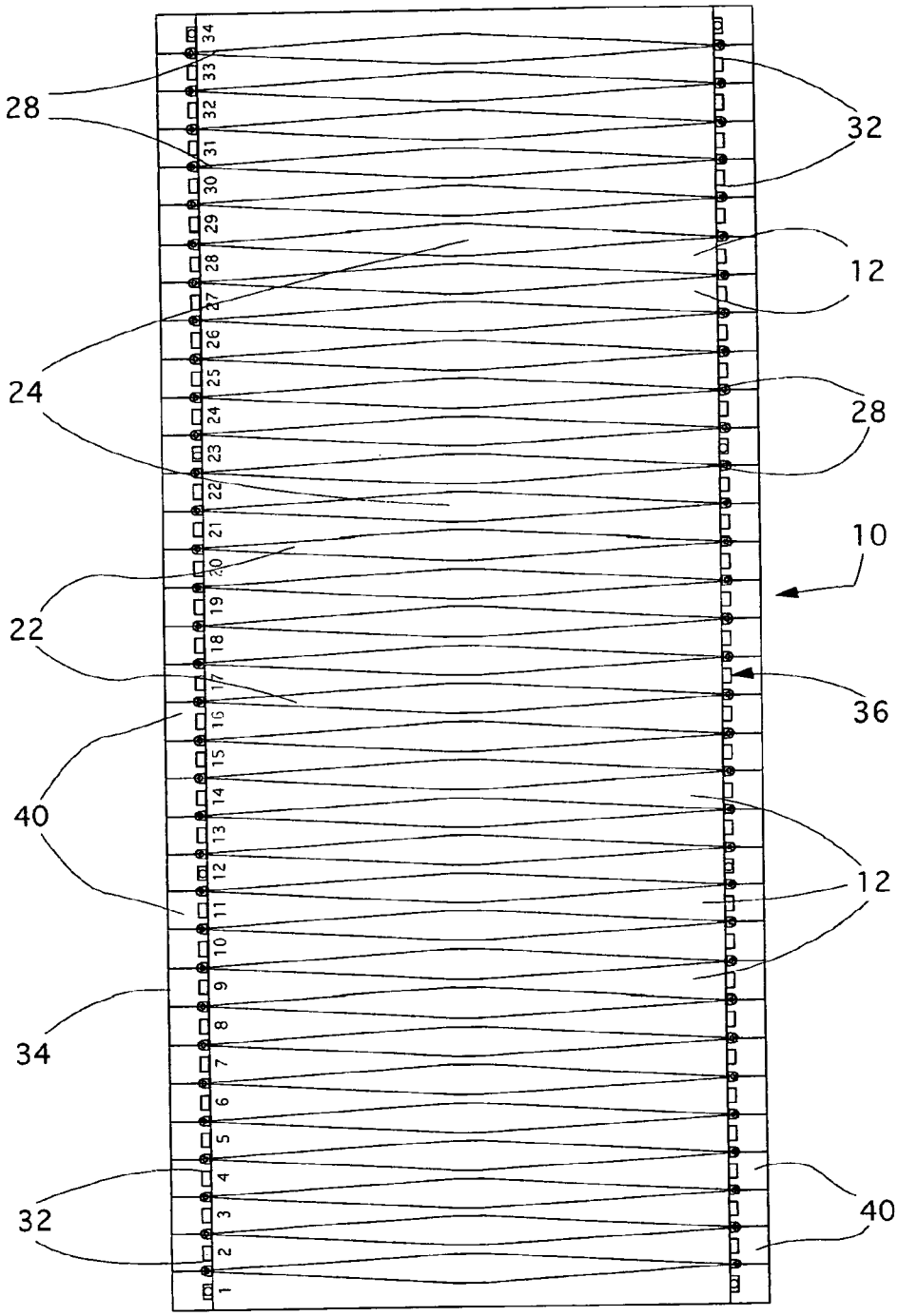
FIG. 1 is a plan view of a roof constructed according to the invention.

FIG. 1 shows a roof 10 constructed according to the invention. The roof 10 is especially adapted for use in buildings that must be constructed rapidly and inexpensively. Such buildings may be required following earthquakes, floods or other natural disasters, in areas that lack roads and public utilities, in economically depressed areas, etc.

The roof 10 is typically not large, for example on the order of 3 by 7 meters, though of course it is in proportion to the area of the space it is designed to cover and protect. If the roof 10 has an overhang forming eves, which is a possibility but not a necessity in accordance with the invention, its area is somewhat larger than the area of the space it is designed to cover and protect, but smaller than the area of a pitched roof having the same overhang and designed to cover and protect the same area.

Figure 3:
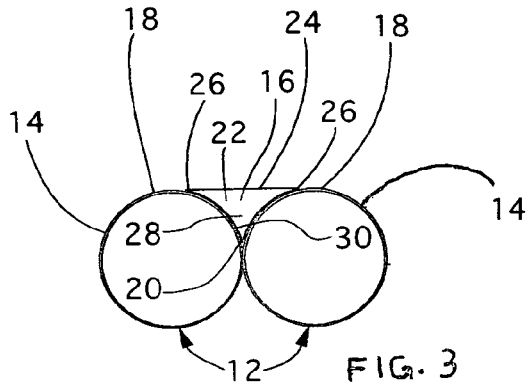
FIG. 3 is a fragmentary view on a larger scale taken at position 3-3 of FIG. 2 and looking in the direction of the arrows.
Figure 2:
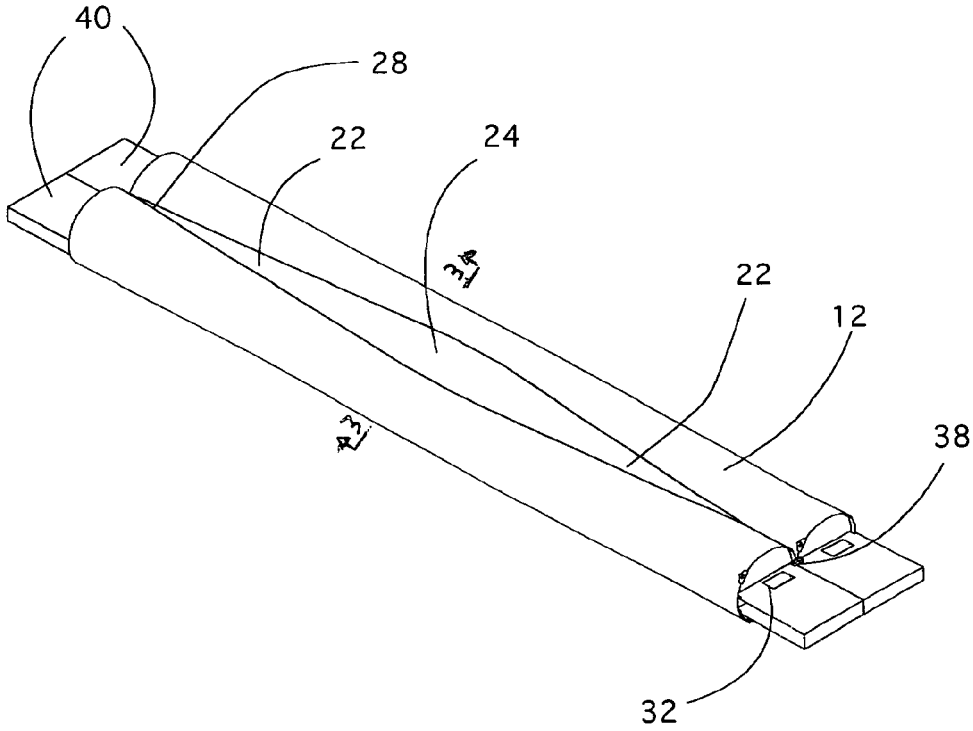
FIG. 2 is a perspective view of a portion of the structure shown in FIG. 1.
Figure 5:
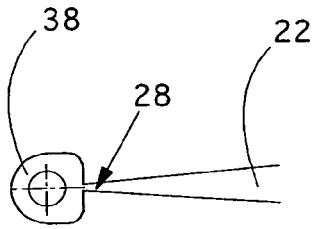
FIG. 5 is a plan view on a larger scale of the left end of the insert shown in FIG. 4.
Figure 6:
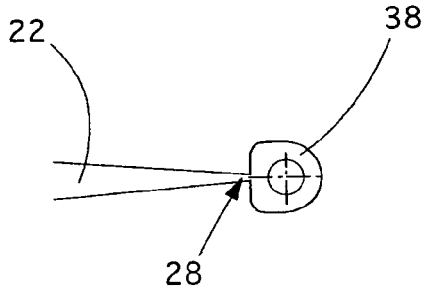
FIG. 6 is a plan view of the right end of the insert shown in FIG. 4.

The roof 10 is substantially flat and comprises a plurality (34 in the example of FIG. 1) of hollow, generally log-shaped members 12 elongated along respective axes and arranged in adjacent, side-by-side relation with the axes extending horizontally. Each log-shaped member 12 has a contoured upper surface 14, best shown in FIG. 3. In the usual case, the log-shaped members 12 are cylindrical, and the contoured upper surface 14 of a horizontal log-shaped member 12 forms the upper half of a cylinder. Applicant's prior U.S. Pat. Nos. 4,619,089 and 5,282,343, incorporated herein by reference, disclose hollow log-shaped members that may be used in accordance with the present invention.

The contoured upper surfaces 14 of adjacent members 12 define between them a space 16 (FIG. 3) that tapers from a maximum width at the highest elevation 18 of the contoured surfaces 14 to a minimum width at the place 20 where the contoured surfaces 14 of adjacent log-shaped members 12 are closest together. The locations 18 and 20 extend horizontally the length of the log-shaped members 12.

In accordance with the invention, a plurality (33 in the example of FIG. 1) of inserts 22 are respectively arranged in the spaces 16 between the contoured upper surfaces 14. Each insert 22 is elongated in the same axial direction as the log-shaped members 12 and has a wide portion 24 that abuts an adjacent pair of the contoured upper surfaces 14 at a relatively high elevation 26.

The inserts 22 taper in abutting relation to the adjacent pair of contoured surfaces 14 to a narrow portion 28 that abuts the contoured surfaces 14 at a relatively low elevation 30 substantially at the ends 32 of the adjacent pair of log-shaped members 12. The inserts 22 therefore slope downward from the midline of the roof towards either opposite edge.

Even though the roof 10 is substantially flat, rain falling on it drains by gravity from the respective contoured upper surfaces 14 to the respective inserts 22 and from the inserts 22 towards the respective narrow portions 28 of the inserts and falls from the roof.

The shape of the contoured upper surfaces 14 is variable in accordance with the design of the building architect or contractor, but the choice of a cylindrical curvature simplifies manufacture of the log-shaped members at the building site. In any event, it is upwardly convex so that water flows by gravity from the surfaces 14 to the inserts 22.

If it is desired to drain rainwater to opposite edges 34 and 36 of the roof 10, as in FIG. 1, the wide portions 24 of the inserts 22 are preferably substantially midway between the narrow portions 28 of the inserts 22, as the figures show. This minimizes the maximum length of the two drainage channels formed between adjacent log-shaped members by equalizing the length in both directions and maximizes the effective pitch of the roof by minimizing the maximum horizontal separation between elevations 26 and 30.

Figure 4:
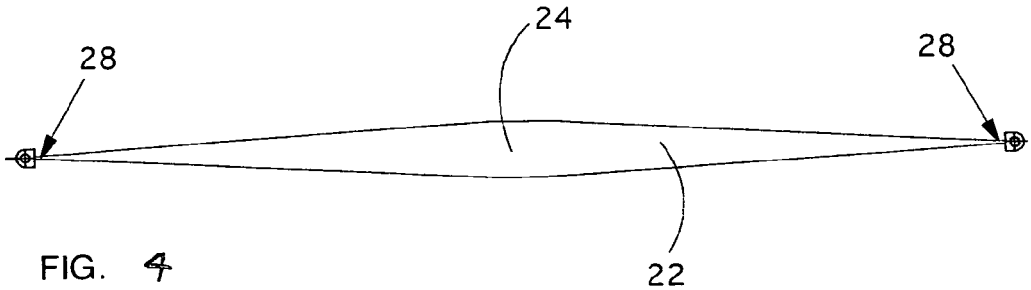
FIG. 4 is a plan view of an insert according to the invention.

It provides a further advantage that can be seen in FIG. 4, for example. That figure can be viewed as a graph in which the horizontal or longitudinal axis extends between the narrow portions 28 and the vertical or transverse axis extends through the wide portion 24. The insert 22 is symmetrical about both axes. If the figure is rotated about either axis, its appearance is unchanged.

That makes the inserts 22 usable in any of four positions: either side can face up and either end can be at either edge of the roof. This reduces the demands on the workers and speeds up and simplifies the construction.

It is of course also within the scope of the invention to displace the wide portions 24 of the inserts 22 towards or even at one edge 34 or 36 of the roof 10.

The inserts 22 are manufactured flat and have straight tapers. The spaces 16 have curved sides. This helps to ensure a snug fit between the inserts 22 and the logs 12. The taper of the inserts 22 is gradual, and both the inserts 22 and the logs 12 are made of one or more thin, flexible, elastic materials such as a light-gauge sheet metal or plastic that readily deforms as the inserts 22 are forced into the spaces 16.

Depending on the relative flexibility of the inserts 22 and the logs 12, either or both will deform. Specifically, either the inserts 22 may assume a trough shape with the concave side facing up, or the logs 12, if originally cylindrical in cross section, may assume a slightly oval shape. Or both effects may occur. Regardless of which effect occurs, the resulting elastic restoration force will hold the inserts 22 and the logs 12 tightly together.

It is also within the scope of the invention to make the edges of the inserts 22 between the wide portion 24 and each narrow portion 28 slightly concave, so that they fit into the spaces 16 without deforming either the inserts 22 or the logs 12.

The narrow portions 28 of the inserts 22 terminate in structure 38 enabling securing the ends of the inserts 22 adjacent to connectors 40. Applicant's patents identified above disclose connectors for "metalog" construction, and improvements therein may become the subject of one or more new patent applications.

To finish the roof, a conventional waterproofing material (not shown) is applied to the roof atop the log-shaped members 12 and the inserts 22.

Thus there is provided in accordance with the invention a novel and highly effective roof that combines important advantages of flat roofs and pitched roofs and has features that make it especially desirable in situations where construction costs must be kept to a minimum. Many modifications of the preferred embodiments of the roof disclosed herein will readily occur to those skilled in the art upon consideration of this disclosure. The invention extends to all structures and methods that fall within the scope of the appended claims.

The invention claimed is:

1. A substantially flat roof comprising:

a plurality of generally log-shaped members made of a material selected from the group consisting of metal and plastic, elongated along respective axes and arranged in adjacent, side-by-side relation with the axes extending horizontally, each log-shaped member having an upwardly convex contoured upper surface, the contoured upper surfaces of adjacent members defining between them a space that tapers from a maximum width at the highest elevation of the contoured upper surfaces to a minimum width where the contoured upper surfaces of adjacent log-shaped members are closest together; and a plurality of inserts respectively arranged in said spaces between said contoured upper surfaces, each insert being elongated in said axial direction, having a wide portion that abuts an adjacent pair of said contoured upper surfaces at a relatively high elevation, and tapering in abutting relation to said adjacent pair of contoured upper surfaces to a narrow portion that abuts said contoured upper surfaces at a relatively low elevation substantially at the ends of said adjacent pair of log-shaped members;

so that rain falling on the substantially flat roof drains down from the respective contoured upper surfaces to the respective inserts and from the inserts down towards the respective narrow portions of the inserts and falls from the roof.

2. A roof according to claim 1 wherein said contoured upper surfaces have a cylindrical curvature.

3. A roof according to claim 1 wherein the log-shaped members are hollow, the inserts are also made of a material selected from the group consisting of metal and plastic, and when the inserts are installed either the log-shaped members or the inserts or both are slightly deformed so that an elastic restoration force helps to ensure a snug fit.

4. A substantially flat roof comprising:

a plurality of generally log-shaped members elongated along respective axes and arranged in adjacent, side-by-side relation with the axes extending horizontally, each log-shaped member having an upwardly convex contoured upper surface, the contoured upper surfaces of adjacent members defining between them a space that tapers from a maximum width at the highest elevation of the contoured upper surfaces to a minimum width where the contoured upper surfaces of adjacent log-shaped members are closest together; and a plurality of inserts respectively arranged in said spaces between said contoured upper surfaces, each insert being elongated in said axial direction, having a wide portion that abuts an adjacent pair of said contoured upper surfaces at a relatively high elevation, and tapering in abutting relation to said adjacent pair of contoured upper surfaces to a narrow portion that abuts said contoured upper surfaces at a relatively low elevation substantially at the ends of said adjacent pair of log-shaped members;

so that rain falling on the substantially flat roof drains from the respective contoured upper surfaces to the respective inserts and from the inserts towards the respective narrow portions of the inserts and falls from the roof;

wherein each of said inserts has a narrow portion at each end thereof and said wide portion of each of said inserts is between said narrow portions of that insert, so that rain drains towards opposite edges of said roof.

5. A roof according to claim 4 wherein said wide portions of said inserts are midway between said opposite edges of said roof.

6. A method of manufacturing a substantially flat roof comprising the steps of:

providing a plurality of generally log-shaped members made of a material selected from the group consisting of metal and plastic and elongated along respective axes;

arranging said log-shaped members in adjacent, side-by-side relation with the axes extending horizontally, each log-shaped member having an upwardly convex contoured upper surface, the contoured upper surfaces of adjacent members defining between them a space that tapers from a maximum width at the highest elevation of the contoured surfaces to a minimum width where the contoured surfaces of adjacent log-shaped members are closest together;

providing a plurality of flat, elongated inserts each having a length substantially equal to the length of said log-shaped members; and mounting said inserts respectively in said spaces between said contoured upper surfaces, each insert having a wide portion that abuts an adjacent pair of said contoured upper surfaces at a relatively high elevation, and tapering in abutting relation to said adjacent pair of contoured surfaces to a narrow portion that abuts said contoured surfaces at a relatively low elevation substantially at the ends of said adjacent pair of log-shaped members;

so that rain falling on the substantially flat roof drains down from the respective contoured upper surfaces to the respective inserts and from the inserts down towards the respective narrow portions of the inserts and falls from the roof.

7. A method according to claim 6 wherein said contoured upper surfaces have a cylindrical curvature and further comprising the step of deforming said contoured upper surfaces or said inserts or both as said inserts are mounted.

8. A method according to claim 6 wherein said inserts are symmetrical about longitudinal and transverse axes so that they can be installed in any of four orientations.

* * * * *